United States Patent [19]

Deutsch

[11] 4,231,278

[45] Nov. 4, 1980

[54] ADAPTIVE COMPUTATION IN A DIGITAL TONE SYNTHESIZER

[75] Inventor: Ralph Deutsch, Sherman Oaks, Calif.

[73] Assignee: Kawai Musical Instrument Mfg. Co. Ltd., Hamamatsu, Japan

[21] Appl. No.: 32,980

[22] Filed: Apr. 25, 1979

[51] Int. Cl.[3] ..... G10H 1/02

[52] U.S. Cl. ..... 84/1.19; 84/1.01

[58] Field of Search ..... 84/1.01,1.03, 1.24, 84/1.19

[56] References Cited

U.S. PATENT DOCUMENTS 4,085,644 4/1978 Deutsch et al. ..... 84/1.01

*Primary Examiner*—J. V. Truhe

*Assistant Examiner*—Forester W. Isen

*Attorney, Agent, or Firm*—Ralph Deutsch

[57] ABSTRACT

In a musical instrument having one or more tone generators in which a plurality of data words corresponding to the amplitudes of a corresponding number of evenly spaced reference points defining the waveform of one cycle of an audio signal are transferred sequentially from a note register to a digital-to-analog converter in repetitive cycles at a rate proportional to the pitch of the tone being generated, apparatus is provided for adaptively computing the set of data points in response to values of preselected harmonic coefficients. The computation apparatus advances past all harmonic coefficients of smaller magnitude than a selected threshold thereby reducing the computation time and making the instrument capable of responding to time varying tonal changes.

12 Claims, 3 Drawing Figures

MULTIPLIER
28
113A
113B
113C
113D
113E
113F
101
104
112
111C
ADVANCE
111A
111B
110A
110B
110C
110D
110E
110F
Cn1
Cn6 ...
R6
R5
R4
R3
R2
R1
114
REFERENCE
SIGNAL
GENERATOR

ADAPTIVE COMPUTATION IN A DIGITAL TONE SYNTHESIZER

FIELD OF THE INVENTION

This invention relates to the production of musical waveshapes, and in particular it is concerned with an improvement for generating such waveshapes in a polyphonic tone synthesizer.

BACKGROUND OF THE INVENTION

In U.S. Pat. No. 4,085,644 there is described a Polyphonic Tone Synthesizer in which a master data set is computed and stored in a main register from which it is transferred to note registers of a plurality of tone generators. The master data set defines the amplitudes of equally spaced points along a half cycle of the audio waveform of the musical tones being generated. Each tone generator receives the words in the master data set and applies them to a digital-to-analog converter at a rate determined by the fundamental pitch of the respective tones being generated by the Polyphonic Tone Synthesizer.

One of the features of the Polyphonic Tone Synthesizer, as described in the above-identified patent, is that the transfer of successive words from the master data set in the main register to an individual note register in the respective tone generators is synchronized with the transfer of words from the note register to the digital-to-analog converter in the respective tone generators. This feature permits the master data set defining the waveform to be recomputed and loaded in the respective tone generators without interrupting the generation of the respective musical notes by the tone generators, thus permitting the waveform of a musical tone to be changed with time without interrupting the resulting musical tone.

The rate at which the waveform can be varied as a function of time is limited by the length of time required for a computation cycle during which the master data set is generated and the length of time required to transfer the data from the main register to the note registers in each of the tone generators. Methods for reducing the time required for the data transfer are described in the copending application Ser. No. 011,056 filed Feb. 9, 1979 entitled "Data Transfer Apparatus For Digital Polyphonic Tone Synthesizer."

An obvious method of reducing the time required for the computation cycle is to simply increase the frequency of the logic master clock which provides the timing signals for the system logic. There are practical as well as economic limitations imposed upon the speed, or frequency, of the master clock. If the Polyphonic Tone Synthesizer is implemented with large scale integrated microelectronics, then the present state-of-the-art limits the master clock to about 2 to 3 mhz. Since the cost of microelectronics rises very fast at the high end of the speed limits, it is desirable to achieve a decreased computation cycle time without increasing the speed of the master clock.

Methods for reducing the computation time are described in the copending application Ser. No. 28,038 filed Apr. 9, 1979 entitled "Even-Odd Symmetric Computation In A Polyphonic Tone Synthesizer." The computation time is reduced by computing a reduced size of the number of points in the master data set. The number of these points is 16 which is a reduction of one-fourth from the required number of 64 points for generating musical tones characterized by 32 harmonics. The reduction in the size of the master data set is accomplished by decomposing the master data set into two component subsets. The first component is generated using only the odd harmonic coefficients and the second component is generated using only the even harmonic coefficients. The component master data sets are stored in two memories. During the transfer cycle, the desired full cycle waveshape data is created by forward and backward addressing of the data stored in the two memories. The addressed data is complemented and added in a specified manner so that the desired full cycle waveshape is created from a total of 16 master data set points instead of using 64 data points as required by the note registers. In this fashion, the time required for the creation of the master data set during the computation cycle is reduced by a factor of four corresponding to the generation of only 16 data points instead of the nominal 64 data points.

SUMMARY OF THE INVENTION

In a Polyphonic Tone Synthesizer of the type described in U.S. Pat. No. 4,085,644 a computation cycle and a data transfer cycle are repetitively and independently implemented to provide data which are converted to musical waveshapes. During the computation cycle a master data set is created by implementing a discrete Fourier algorithm using a stored set of harmonic coefficients which characterize a preselected musical tone. The computations are carried out at a fast rate which may by nonsynchronous with any musical frequency. Preferably the harmonic coefficients and the orthogonal functions required by the Fourier algorithm are stored in digital form and the computations are carried out digitally. At the end of a computation cycle the master data set is stored in a main register.

Following a computation cycle, a transfer cycle is initiated during which the master data set is transferred to preselected members of a multiplicity of note registers. Tone generation continues uninterrupted during the computation and the transfer cycles.

The present invention is directed to an improved arrangement for generating the master data set. By the present invention the duration of the computation cycle is adaptive to the preselected set of harmonic coefficients which are used in the computation of the master data set. In this fashion the computation time is less for tones created using only a few harmonics as compared to tones which use the full 32 harmonic capability.

An application of the present invention is to enable a single design implementation of computational system elements to be used to configure different classes, or price categories, of electronic musical instruments. For example, a "top of the line" model would be an instrument in which the tonal waveshapes can be synthesized to 32 harmonics. 32 harmonics in a waveshape provides very good tonal capability for almost any desired musical effect. The second set of models would be limited to 16 harmonics. The smaller number of harmonics in the tone lends itself to lower priced musical instruments.

BRIEF DESCRIPTION OF THE DRAWINGS

The detailed description of the invention is made with reference to the accompanying drawings wherein like numerals designate like components in the figures.

DETAILED DESCRIPTION

Figure 1:
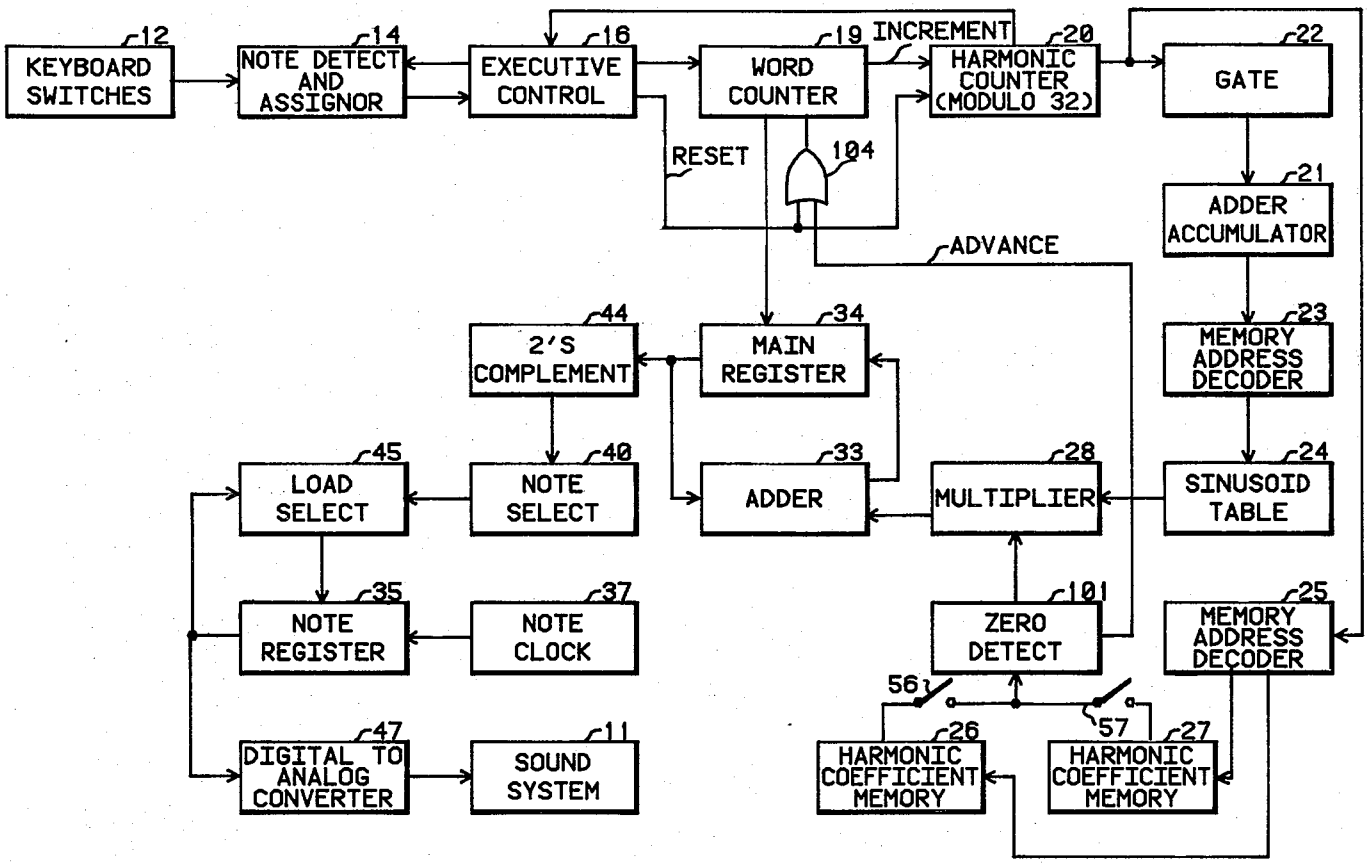
FIG. 1 is a schematic block diagram of an embodiment of the invention.
Figure 2:
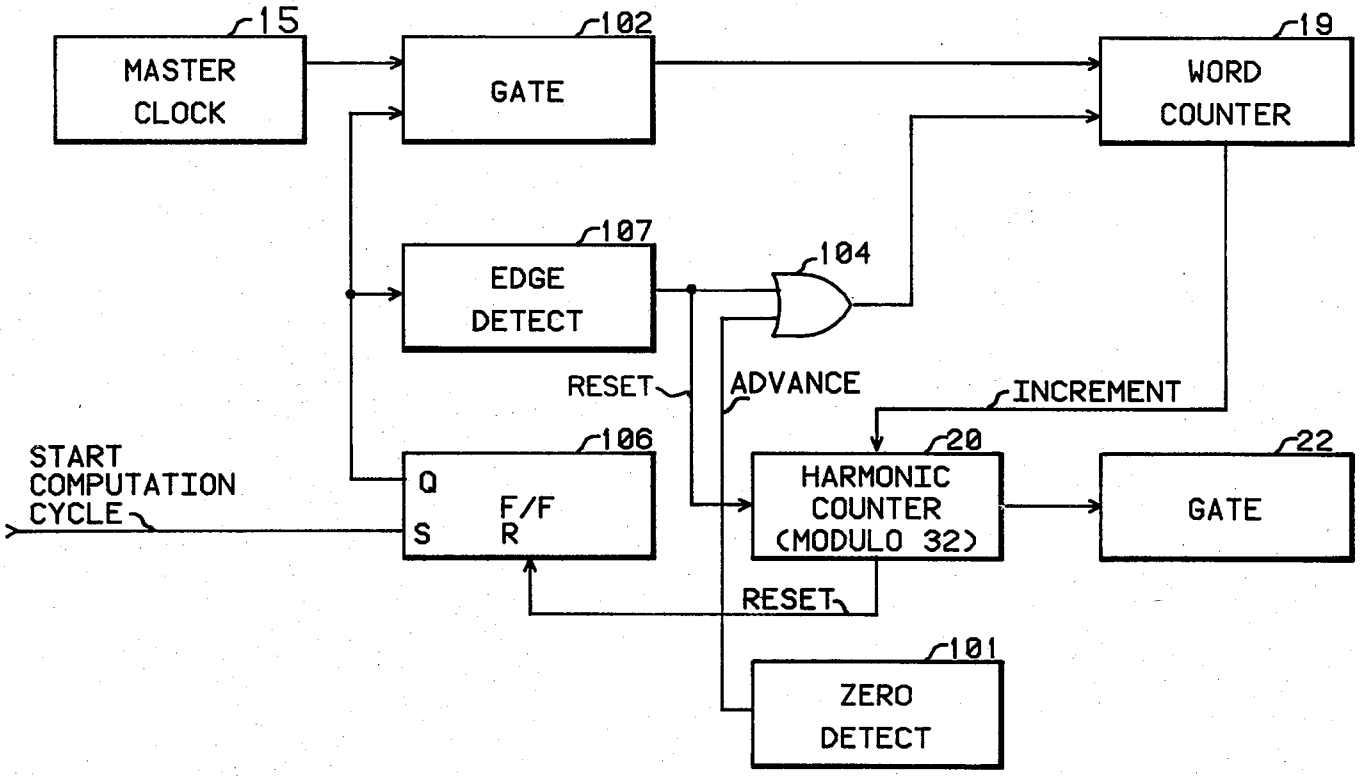
FIG. 2 is a schematic block diagram showing details of the executive control.

The embodiments of FIGS. 1–2 are shown and described as modifications to the Polyphonic Tone Synthesizer described in detail in U.S. Pat. No. 4,085,644 hereby incorporated by reference. All two-digit reference numbers used in the drawings correspond to the similarly numbered elements in the disclosure of the above-identified patent.

As described in the patent, the Polyphonic Tone Synthesizer includes an instrument keyboard 12 which, for example, corresponds to the conventional keyboard of an electronic musical instrument such as an electronic organ. By depressing one or more keys on the instrument keyboard, a note detect and assignor circuit 14 stores the note information for the keys that have been actuated and assigns each actuated note to one of twelve separate tone generators. A note detect and assignor circuit is described in U.S. Pat. No. 4,022,098 which is hereby incorporated by reference. When one or more keys has been depressed, an executive control circuit 16 initiates a computation cycle during which a master data set consisting of 32 words is computed and stored in a main register 34. The 32 words are generated with values which correspond to the amplitudes of 32 equally spaced points for one-half cycle of the audio waveform of the tone to be generated by the tone generators. The manner in which the Polyphonic Tone Synthesizer generates the waveform defining master data set is described in detail in U.S. Pat. No. 4,085,644.

At the completion of a computation cycle, the executive control 16 initiates a transfer cycle during which the master data set stored in the main register 34 is transferred to a note register 35 in the assigned tone generators. The note register 35 stores 64 words corresponding to one complete cycle of the audio tone to be generated. As described in U.S. Pat. No. 4,085,644, the 32 words of the master data set residing in the main register 34 are expanded to 64 words in the note register 35 during the transfer cycle by using either the even or the odd symmetry of the Fourier series from which the master data set is generated. If even symmetry is used, that is, all cosine functions are used in the Fourier algorithm, it is only necessary to reverse the order of the 32 data points of the master data set to provide an additional 32 words defining the second half cycle in the note registers. If odd symmetry is used, that is, all sine functions are used in the Fourier algorithm, the order of the second group of 32 points must be reversed and the algebraic sign of the data must be changed by an operation such as performing a 2's complement with binary numbers.

Once the 64 data points which define one complete cycle of the desired audio waveshape are stored in the note register 35, the data points are read out of the note register 35 in sequence and applied to a digital-to-analog converter 47 which converts the input digital data into an analog voltage of the desired audio waveshape which is then applied to a sound system 11. The data points are transferred out of the note register 35 at a clock rate controlled by an associated note clock 37 in each of the tone generators. The note clock is a voltage controlled oscillator whose frequency is set at 64 times the fundamental frequency of the keyed note on the keyboard. Thus all 64 data points are transferred to the digital-to-analog converter 47 in a time interval corresponding to one period at the pitch or fundamental frequency of the selected note.

There are a variety of methods for implementing the voltage controlled oscillator used for the note clock 37. One such implementation is described in detail in U.S. Pat. No. 4,067,254 which is hereby incorporated by reference.

The number of data points in the master data set is a function of the maximum number of harmonics desired for the generated tonal structure. The rule is that the maximum number of harmonics is equal to one-half of the number of data points defining a full cycle of the audio waveshape. Thus, the preferred embodiment uses 64 data points which permits the generation of tones having a maximum of 32 harmonics.

As further described in the above-identified U.S. Pat. No. 4,085,644, it is desirable to be able to continuously recompute the master data which resides in the main register 34 and to reload this data in the note register 35 while the associated key on the keyboard remains depressed. This is accomplished without interrupting the flow of data points to the digital-to-analog converter at the note clock rate.

The present invention is directed toward an arrangement for adapting the computation to the values of harmonic coefficients selected by the instrument's tone switches. Tone switches are sometimes called stops using terminology borrowed from wind blown pipe organs.

As described in the above referenced U.S. Pat. No. 4,085,644 the master data set can be calculated according to the relation $$Z_N = \sum_{q=1}^{M} c_q \sin(\pi N q/M) \qquad \text{(Equation 1)}$$

where $N=1,2,\ldots,$ 2W is the index number for the master data set words, $q=1,2,\ldots,$ M is the harmonic number, M=W is the number of harmonics used in the generation of the master data set, and $c_q$ are the harmonic coefficients preselected for a desired output tone quality.

Each term in the summation shown in Equation 1 is called a harmonic component.

The adaptive computation system features are shown in FIG. 1. At the start of a computation during which the master data set is computed, both the word counter 19 and the harmonic counter 20 are initialized to zero value by the executive control 16 in a manner described below.

The selection of a set of harmonic coefficients is controlled by the settings of the tone switches 56 and 57. These switches determine if the harmonic coefficients addressed by the memory address decoder 25 will be those stored in the harmonic coefficient memory 27 or the harmonic coefficient memory 26.

The circuitry within the zero detect 101 examines each of the harmonic coefficients accessed from the selected harmonic coefficient memory before the coefficient is transferred to the multiplier 28. If the current harmonic coefficient is detected to have zero value, the zero detect 101 generates an ADVANCE signal.

The ADVANCE signal is combined in the OR-gate 104 with the reset signal created by the executive control. The output of OR-gate 104 will reset the word counter 19 is this output is in the "1" logic state.

Each time the word counter 19 is reset, an INCREMENT signal is generated by the word counter. The INCREMENT is used to increment the state of the harmonic counter 20. Therefore each time the ADVANCE signal is generated by the zero detect 101 because a zero-value harmonic coefficient has been detected, the word counter is reset to its initial state and the harmonic counter is incremented by one count. This action eliminates 64 computation times of multiplication and adds in the computation cycle. The eliminated 64 steps are completely redundant because the net result would be to add zero values to the prior partial data sums stored in the main register 34.

When the harmonic counter 20 reaches its maximum count of 32 it self-resets to an initial state because it is constricted to count modulo 32.

When the harmonic counter resets itself, a modulo reset signal is generated which is transmitted to the executive control 16 to indicate that a computation cycle has been completed.

Figure 3:
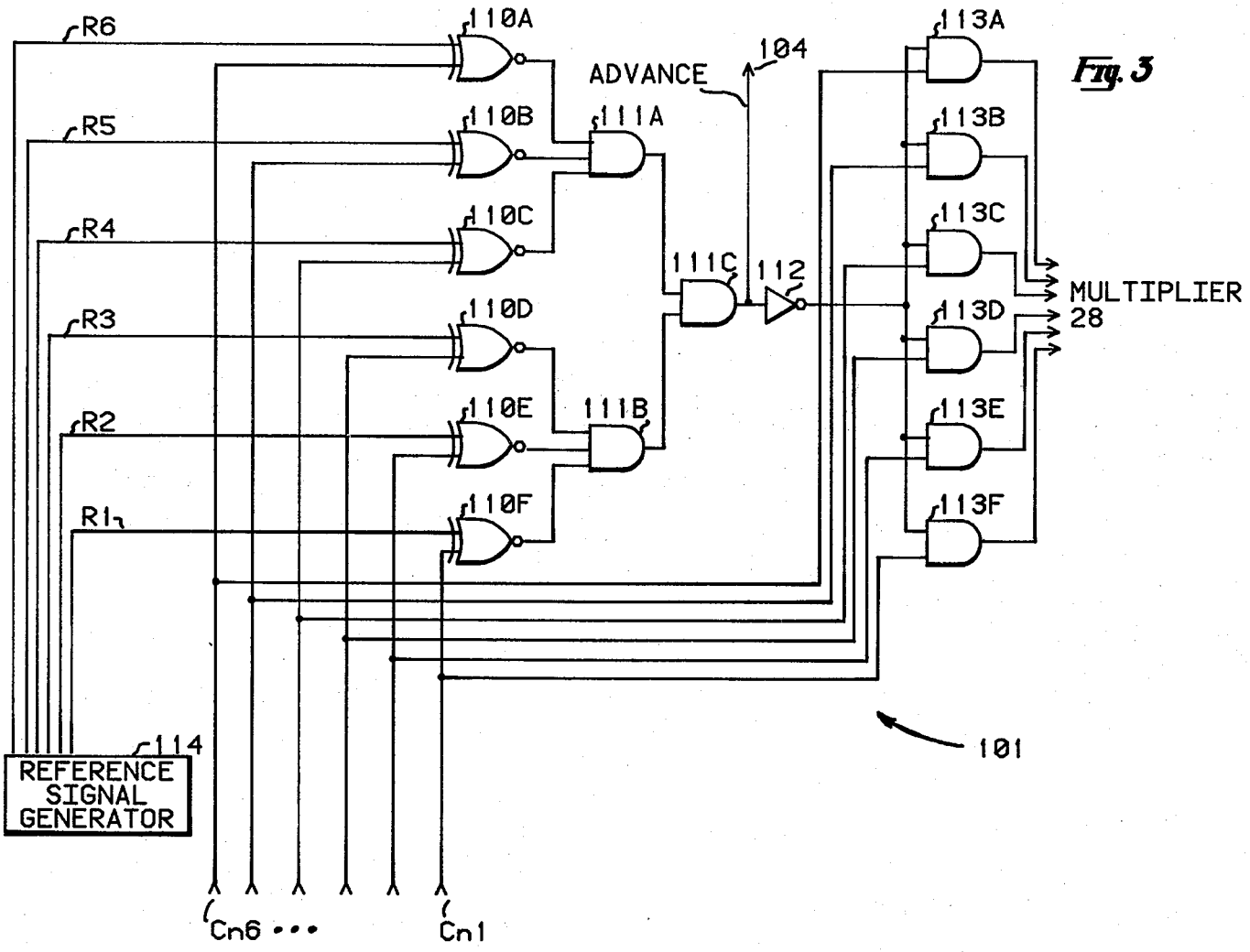
FIG. 3 is a schematic logic diagram showing details of the zero detect circuitry.

FIG. 3 shows the logic circuitry which is contained in the zero detect 16 system block. The input harmonic coefficient $c_j$ is composed of six binary bits cj1 to cj6. For a zero-detect logic all the 6 bits of the reference signal R will have zero value. The bit-by-bit comparison is accomplished by the set of EX-NOR gates 110A through 110F and the set of AND gates 111A through 111C. If all the bits of $c_j$ are zero, then an ADVANCE signal is generated at the output of the AND gate 11C. The harmonic coefficient $c_j$ is also applied to the set of AND gates 113A through 113F. If the ADVANCE signal is "0", then these gates will transmit the harmonic coefficient $c_j$ to the multiplier 28. If the ADVANCE signal is "1", then these gates inhibit the harmonic coefficient from reaching the multiplier 28.

FIG. 2 shows the elements of the executive control 16 that are used to provide the adaptive computation in response to the values of the harmonic coefficients. A computation cycle is initiated by setting flip-flop 106 so that its output signal is $Q=$"1". When $Q=$"1", a RESET signal is generated by means of an edge detect circuit 107. The RESET signal is used to place both the word counter 19 and harmonic counter 20 into their initial state. The $Q=$"1" state of flip-flop 106 also causes the gate 102 to transfer timing signals from the master clock 15 to the word counter 19.

When the harmonic counter 20 is incremented after it is in its maximum count state, it resets to its initial state and generates a RESET signal. This RESET signal is sent to reset the flip-flop 106. The action of resetting this flip-flop terminates the computation cycle.

Instead of implementing the zero-detect 101 to generate the ADVANCE signal in response to a zero valued harmonic coefficient, it is immediately evident to those skilled in the art, that the ADVANCE signal can be generated in response to any preselected value. This is accomplished as shown in FIG. 3 by preselecting a value of the comparison signal R. Special tonal effects can be obtained by making R take on values which can be varied with time. As R varies, so will the tone quality because various harmonic coefficients are eliminated when R has a larger value than these coefficients. One means for varying the magnitude of the reference signal R is to generate R by means of an ADSR envelope generator. A suitable envelope generator is described in U.S. Pat. No. 4,079,650 which is hereby incorporated by reference.

The system shown in FIG. 1 can be used as the foundation for models of electronic musical instruments which are characterized by the number of harmonics that are used to synthesize the musical waveshapes. For example, the system described in connection with FIG. 1 had 32 harmonics. If the harmonic coefficients are stored with every harmonic greater than 16 having a zero value, then the calculation of the master data is automatically limited to 16 harmonics and the computation cycle time is automatically adaptively reduced to one-half of the time required for 32 harmonics.

I claim:

1. In a musical instrument having one or more tone generators in which a plurality of data words corresponding to the amplitudes of a corresponding number of evenly spaced points defining the waveform of one cycle of an audio signal are computed by a Fourier transform using stored values of harmonic coefficients and in which the waveform points are transferred sequentially from a note register to a digital-to-analog converter at a rate proportional to the pitch of the tone being generated the improvement for generating said data words in a time interval whose length is determined by the values of the harmonic coefficients comprising:

a harmonic coefficient memory means for storing values of harmonic coefficients, memory addressing means for reading out harmonic coefficients from said harmonic coefficient memory, a computation means using said values of harmonic coefficients wherein said data words are computed during a computation cycle, a comparator means whereby a comparison signal is generated in response to a preselected value of a harmonic coefficient read out of said harmonic coefficient memory, and termination means responsive to said comparison signal whereby said harmonic coefficients are inhibited and not provided to said computation means and whereby said computation cycle is terminated thereby causing the duration of said computation cycle to be altered in response to said preselected value of a harmonic coefficient.

2. A musical instrument according to claim 1 wherein said computation means comprises:

a word counter incremented at each computation time in said computation cycle wherein said word counter counts modulo the number of said data words;

modulo reset whereby a reset signal is created when an increment to said word counter returns the count to an initial state, a harmonic counter incremented by said reset signal wherein the harmonic counter counts modulo a preselected number, an adder-accumulator for adding successive values of the content of said harmonic counter, a sinusoid table comprising a memory storing values of trigonometric functions, a second addressing means for addressing values from said sinusoid table in response to contents of said adder-accumulator, a multiplier means for multiplying each said addressed value from said sinusoid table with a corresponding harmonic coefficient read out from said harmonic coefficient memory means, and a data memory means for storing values provided by said multiplier means.

3. A musical instrument according to claim 2 wherein said computation means comprises;

a second modulo reset whereby a termination signal is created when said reset signal increments said harmonic counter causing it to return to its initial state, clock means for generating timing signals, a counting gate interposed between said clock means and said word counter whereby said timing signals are transferred in response to a control signal, control signal generating circuitry whereby said control signal is created at the start of said computation cycle and whereby said control signal generation is terminated in response to said termination signal created by said second modulo reset thereby terminating said computation cycle.

4. A musical instrument according to claim 1 wherein said comparator means comprises;

a reference signal generation means for creatng a reference signal, and comparison circuitry means responsive to said reference signal and to harmonic coefficients read out of said harmonic coefficient memory wherein said comparison signal is generated if the harmonic coefficient is less than the value of the reference signal.

5. A musical instrument according to claim 4 wherein said reference signal is generated with time variant values.

6. A digital polyphonic tone synthesizer in which musical waveshapes are computed by means of a Fourier transform, wherein the computation is adaptive to the values of the harmonic coefficients used in said transform, comprising;

a keyboard comprising a plurality of key switches, a plurality of tone switches wherein each setting of the tone switches corresponds to a selection of a predetermined sound waveshape, a plurality of memories containing values of harmonic coefficients, selection means responsive to setting of said tone switches for sequentially selecting harmonic coefficients from said plurality of memories, a reference signal generation means, a comparison means whereby a comparison signal is created when one of said sequentially selected harmonic coefficients is less than said reference signal, and digital computing means responsive to said harmonic coefficients and said comparison signal for generating a master data set comprising points on said musical waveshape according to said Fourier transform.

7. A musical instrument according to claim 6 wherein said digital computing means further comprises;

inhibit circuitry interposed between said plurality of memories and said digital computing means wherein in response to said comparison signals said harmonic coefficients are not provided to said digital computing means, and advance circuitry wherein said Fourier transform is not computed in response to said comparison signal.

8. A musical instrument according to claim 7 further comprising;

a plurality of registers, transfer means responsive to the setting of said key switches whereby said master data set is transferred from said digital computing means to selected members of said plurality of registers, a plurality of variable frequency clock generators each associated with a member of said plurality of registers whereby associated registers are shifted at a selected clock rate, means responsive to operation of any member of said plurality of key switches for setting the frequencies of said clock generators to predetermined values assigned to key switches, digital-to-analog converter means coupled to said plurality of said registers, and means for repeatedly shifting the stored master data set in each member of said plurality of registers serially to said digital-to-analog converter means in synchronism with said associated clock generator, whereby the digital-to-analog converter means generates a plurality of analog output signals each having a fundamental frequency determined by a selected key on said keyboard and a waveshape determined by the setting of said stop switches.

9. A musical instrument according to claim 6 wherein said digital computing means further comprises;

a sinusoid table storing sine values, and means for computing numbers $Z_N$ in said master data set in accordance with the relation $$Z_N = \sum_{q=1}^{N} c_q \sin(\pi Nq/M)$$

here $q = 1,2,3, \ldots ,M$, $N = 1,2, \ldots ,2M$ and M is the number of harmonic components defining said number $Z_N$, $c_q$ is an element of the harmonic coefficient stored in said plurality of memories and $\sin \pi(Nq/M)$ is a value addressed from said sinusoid table.

10. A musical instrument according to claim 9 wherein said means for computing numbers computes 2M terms for each value of said number q if said comparison signal is not created and wherein the means for computing numbers does not compute any terms for a value of said $c_q$ for which said comparison signal is created.

11. A musical instrument according to claim 10 wherein said digital computing means is inhibited when all said values of $Z_N$ have been computed.

12. A musical instrument according to claim 3 wherein said comparator means further comprises word reset circuitry whereby said word counter is returned to its initial state in response to said comparison signal.

* * * * *